US009721701B2

(12) United States Patent
Liu et al.

(10) Patent No.: US 9,721,701 B2
(45) Date of Patent: Aug. 1, 2017

(54) CONDUCTIVE COMPOSITIONS FOR JACKET LAYERS AND CABLES THEREOF

(71) Applicant: General Cable Technologies Corporation, Highland Heights, KY (US)

(72) Inventors: Jianmin Liu, Carmel, IN (US); Sean William Culligan, Zionsville, IN (US); Sathish Kumar Ranganathan, Indianapolis, IN (US); Vitthal Abaso Sawant, Indianapolis, IN (US)

(73) Assignee: General Cable Technologies Corporation, Highland Heights, KY (US)

( * ) Notice: Subject to any disclaimer, the term of this patent is extended or adjusted under 35 U.S.C. 154(b) by 0 days.

(21) Appl. No.: 15/374,421

(22) Filed: Dec. 9, 2016

(65) Prior Publication Data

US 2017/0169920 A1 Jun. 15, 2017

Related U.S. Application Data

(60) Provisional application No. 62/266,366, filed on Dec. 11, 2015.

(51) Int. Cl.

| | |
|---|---|
| ***H01B 5/00*** | (2006.01) |
| ***H01B 9/02*** | (2006.01) |
| ***H01B 1/24*** | (2006.01) |
| ***H01B 3/44*** | (2006.01) |
| ***H01B 7/42*** | (2006.01) |

(52) U.S. Cl.

CPC ..... *H01B 9/02* (2013.01); *H01B 1/24* (2013.01); *H01B 3/441* (2013.01); *H01B 7/428* (2013.01)

(58) Field of Classification Search

CPC . H01B 9/02; H01B 1/24; H01B 3/441; H01B 7/428

USPC ..... 174/126.2

See application file for complete search history.

(56) References Cited

U.S. PATENT DOCUMENTS

| | | | | |
|---|---|---|---|---|
| 5,019,614 | A | 5/1991 | Klei | |
| 5,733,480 | A * | 3/1998 | Lee | B32B 27/20 106/476 |
| 6,086,792 | A | 7/2000 | Reid et al. | |
| 6,468,636 | B1 | 10/2002 | Hirano | |
| 6,864,429 | B2 * | 3/2005 | Easter | H01B 1/24 174/110 R |
| 2005/0100502 | A1 * | 5/2005 | Krauss | C09D 11/324 423/449.1 |

(Continued)

OTHER PUBLICATIONS

Young, Lee W.; International Search Report and Written Opinion of the International Searching Authority, issued in International Application No. PCT/US2016/065885; dated as mailed on Mar. 31, 2017; 8 pages.

*Primary Examiner* — Sherman Ng

(74) *Attorney, Agent, or Firm* — Ulmer & Berne LLP

(57) ABSTRACT

A conductive composition can include a polyolefin base polymer, a high structure carbon black and a low structure carbon black. The conductive composition can exhibit two or more of a thermal conductivity of about 0.27 W/mK or more when measured at about 75° C., a volume resistivity of about 75 ohm-m or less when measured at about 90° C. and an elongation at break of about 300% or more. Cables having coverings formed of such conductive compositions and methods of making such cables are also described herein.

20 Claims, 1 Drawing Sheet

(56) References Cited

U.S. PATENT DOCUMENTS

| | | | | |
|---|---|---|---|---|
| 2011/0017509 | A1* | 1/2011 | Galletti | H01B 1/24<br>174/74 R |
| 2011/0172383 | A1 | 7/2011 | Yeh et al. | |
| 2012/0058324 | A1 | 3/2012 | St. Jean et al. | |
| 2013/0037759 | A1* | 2/2013 | Svanberg | H01B 1/24<br>252/511 |
| 2015/0087764 | A1* | 3/2015 | Sanchez Garcia | C09C 1/56<br>524/496 |
| 2015/0159069 | A1 | 6/2015 | Ranganathan et al. | |
| 2015/0194240 | A1* | 7/2015 | Ranganathan | H01B 7/292<br>174/126.2 |

* cited by examiner

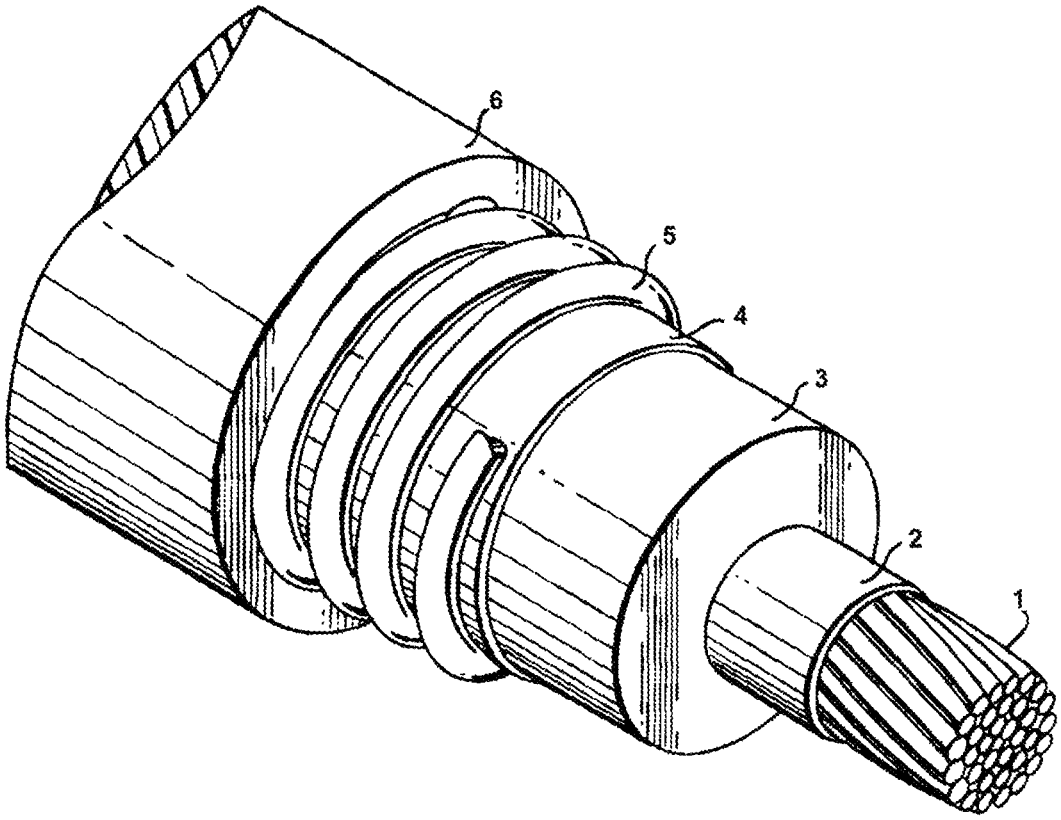
6
5
4
3
2
1

CONDUCTIVE COMPOSITIONS FOR JACKET LAYERS AND CABLES THEREOF

REFERENCE TO RELATED APPLICATIONS

The present application claims the priority benefit of U.S. provisional patent application Ser. No. 62/266,366, entitled CONDUCTIVE COMPOSITIONS FOR JACKET LAYERS AND CABLES THEREOF, filed Dec. 11, 2015, and hereby incorporates the same application herein by reference in its entirety.

TECHNICAL FIELD

The present disclosure generally relates to conductive compositions exhibiting high electrical and/or thermal conductivity; and more particularly the use of such conductive compositions in jacket layers of power cables.

BACKGROUND

Conventional power cables typically include a conductor surrounded by one or more insulation layers and a jacket layer. Such insulation and jacket layers can provide certain desired properties to the conventional power cable such as improved electrical performance and durability. However, conductor resistance losses inherent to electric power transmission can generate heat at the conductor which must be dissipated through each of the surrounding layers. The construction of a power cable with an improved conductive jacket layer would allow for construction of a more efficient power cable for a given gauge by minimizing temperature dependent resistance losses by allowing for increased dissipation of heat from the conductor. Consequently, there is a need for an improved conductive composition for power cables that exhibits increased thermal conductance while still providing desired electrical, physical, and mechanical properties.

SUMMARY

In accordance with one example, a cable includes one or more conductors and a covering surrounding the one or more conductors. The covering is formed from a conductive composition. The conductive composition includes from about 40% to about 90%, by weight of the conductive composition, of a polyolefin base polymer; from about 10% to about 30%, by weight of the conductive composition, of a first carbon black material; and from about 0.5% to about 10%, by weight of the conductive composition, of a second carbon black material. The first carbon black material has a Brunauer, Emmett, and Teller ("BET") value of about 400 or less and an Oil Adsorption Number ("OAN") value in accordance to ASTM D2414 (2014) of about 250 or less. The second carbon black material has a BET value of about 400 or more and an OAN value of about 250 or more. The covering exhibits two or more of: a thermal conductivity of about 0.27 W/mK or more when measured at about 75° C., a volume resistivity of about 75 ohm-m or less when measured at about 90° C., and an elongation at break of about 300% or more.

In accordance with another example, a conductive composition includes from about 40% to about 90%, by weight, of a polyolefin base polymer; from about 10% to about 30%, by weight, of a first carbon black material; and from about 0.5% to about 10%, by weight, of a second carbon black material. The first carbon black material has a Brunauer, Emmett, and Teller ("BET") value of about 400 or less and an Oil Adsorption Number ("OAN") value in accordance to ASTM D2414 (2014) of about 250 or less. The second carbon black material has a BET value of about 400 or more and an OAN value of about 250 or more. The conductive composition exhibits two or more of: a thermal conductivity of about 0.27 W/mK or more when measured at about 75° C., a volume resistivity of about 75 ohm-m or less when measured at about 90° C., and an elongation at break of about 300% or more.

In accordance with another example, a cable includes one or more conductors and a covering surrounding the one or more conductors. The covering is formed from a covering composition. The covering composition includes from about 40% to about 90%, by weight of the jacket composition, of a polyolefin base polymer; from about 10% to about 30%, by weight of the jacket composition, of a first carbon black material; and from about 0.5% to about 10%, by weight of the jacket composition, of a second carbon black material. The first carbon black material has a Brunauer, Emmett, and Teller ("BET") value of about 400 or less and an Oil Adsorption Number ("OAN") value in accordance to ASTM D2414 (2014) of about 250 or less. The second carbon black material has a BET value of about 400 or more and an OAN value of about 250 or more. The covering exhibits two or more of: a volume resistivity of about 75 ohm-m or less when measured at about 90° C., an elongation at break of about 300% or more, and an elongation at break percentage after aging at 100° C. for 168 hours of about 70% or more of the unaged elongation at break percentage.

BRIEF DESCRIPTION OF THE DRAWINGS

FIG. 1 depicts a perspective view of one example of a power cable having a jacket layer including a conductive composition.

DETAILED DESCRIPTION

Conductive compositions can generally be useful in the formation of jacket layers for power cables. Jacket layers provide, or influence, a number of power cable properties including electrical, physical, thermal, and mechanical properties. For example, a jacket layer provides durability and handling characteristics to power cables. Jacket layers formed with conductive compositions as described herein can allow for the construction of power cables having improved heat transfer properties while also retaining the physical, mechanical, and electrical properties necessary for operation and use of the power cable. For example, jacket layers formed with the conductive compositions as described herein can have two or more of a thermal conductivity of about 0.30 W/mK or more when measured in accordance with ASTM E1952 (2011) mDSC method at 75° C., an elongation at break of about 300% or more, and a volume resistivity of about 75 ohm-m or less when measured at 90° C. Conductive compositions as described herein can include a polyolefin base polymer. In certain embodiments, a suitable polyolefin base polymer can include a polyethylene polymer. For example, a polyolefin base polymer can be one or more of low-density polyethylene ("LDPE"), high-density polyethylene ("HDPE"), high-molecular weight polyethylene ("HMWPE"), ultra-high molecular weight polyethylene ("UHMWPE"), linear low-density polyethylene ("LLDPE"), and very low-density polyethylene. According to certain embodiments, a suitable polyethylene base polymer can be a unimodal polyethylene polymer, a bimodal polyethylene polymer, or a blend thereof. For example, in certain embodiments, the polyolefin base polymer can include a blend of bimodal HDPE and a unimodal LLDPE. In certain embodiments, HDPE, if included, can be bimodal.

A conductive composition can, according to certain embodiments, contain from about 40% to about 90%, by weight, or a polyolefin base polymer, in certain embodiments from about 55% to about 85%, by weight, of a polyolefin base polymer; and in certain embodiments, from about 60% to about 80%, by weight, of a polyolefin base polymer. In certain embodiments, the polyolefin base polymer can be 85% or less, by weight, of the conductive composition. As can be appreciated, the quantities of each component in the polyolefin base polymer can also vary. For example, a conductive composition can include about 50% to about 70% of a bimodal HDPE and about 3% to about 7% of a unimodal LLDPE. In certain embodiments, the polyolefin base polymer can be entirely unimodal or bimodal LLDPE.

According to certain embodiments, a conductive composition can additionally, or alternatively, include copolymers or blends of several different polymers. For example, the polyolefin base polymer can be formed from the polymerization of ethylene with at least one co-monomer selected from the group consisting of $C_3$ to $C_{20}$ alpha-olefins, $C_3$ to $C_{20}$ polyenes and combinations thereof. As will be appreciated, polymerization of ethylene with such co-monomers can produce ethylene/alpha-olefin copolymers or ethylene/alpha-olefin/diene terpolymers.

According to certain embodiments, such alpha-olefins can alternatively contain from 3 to 16 carbon atoms or can contain from 3 to 8 carbon atoms. A non-limiting list of suitable alpha-olefins includes propylene, 1-butene, 1-pentene, 1-hexene, 1-octene, and 1-dodecene.

Likewise, according to certain embodiments, a polyene can alternatively contain from 4 to 20 carbon atoms, or can contain from 4 to 15 carbon atoms. In certain embodiments, the polyene can be a diene further including, for example, straight chain dienes, branched chain dienes, cyclic hydrocarbon dienes, and non-conjugated dienes. Non-limiting examples of suitable dienes can include straight chain acyclic dienes: 1,3-butadiene; 1,4-hexadiene, and 1,6-octadiene; branched chain acyclic dienes: 5-methyl-1,4-hexadiene; 3,7-dimethyl-1,6-octadiene; 3,7-dimethyl-1,7-octadiene; and mixed isomers of dihydro myricene and dihydroocinene; single ring alicyclic dienes: 1,3-cyclopentadiene; 1,4-cylcohexadiene; 1,5-cyclooctadiene; and 1,5-cyclododecadiene; multi-ring alicyclic fused and bridged ring dienes: tetrahydroindene; methyl tetrahydroindene; dicylcopentadiene; bicyclo-(2,2,1)-hepta-2-5-diene; alkenyl; alkylidene; cycloalkenyl; and cycloalkylidene norbornenes such as 5-methylene-2morbornene (MNB); 5-propenyl-2-norbornene; 5-isopropylidene-2-norbornene; 5-(4-cyclopentenyl)-2-norbornene; 5-cyclohexylidene-2-norbornene; and norbornene.

In certain embodiments, a conductive composition can include about 1% to about 3% polyalphaolefins.

According to certain embodiments, a conductive composition can further include additional polymers. For example, in certain embodiments, a suitable elastomer can be included in the conductive composition. A non-limiting example of a suitable elastomer is a propylene-based elastomer. Polyethylene copolymers can also be suitable. A conductive composition can, according to certain embodiments, contain from about 6% to about 14%, by weight of the conductive composition, of an elastomer.

As can be appreciated, the components of the polyolefin base polymer can be polymerized by any suitable method including, for example, metallocene catalysis reactions. Details of metallocene catalyzation processes are disclosed in U.S. Pat. No. 6,451,894, U.S. Pat. No. 6,376,623, and U.S. Pat. No. 6,329,454, each of which is hereby incorporated by reference. Metallocene-catalyzed olefin copolymers can also be commercially obtained through various suppliers including the ExxonMobil Chemical Company (Houston, Tex.) and the Dow Chemical Company. Metallocene catalysis can allow for the polymerization of precise polymeric structures.

According to certain embodiments, a conductive composition can include one or more electrically conductive carbon black materials. Examples of suitable carbon black materials that can be included in the conductive composition include, for example, furnace carbon black, channel carbon black, acetylene carbon black, graphitic or graphitized carbon black, thermal carbon black, lamp carbon black, highly conductive carbon black, and combinations thereof. As can be appreciated, carbon black materials can also be categorized by certain distinguishing properties such as Brunauer, Emmett, and Teller ("BET") adsorption values and Oil Adsorption Number ("OAN") values measured in accordance to ASTM D2414 (2014). OAN values can indicate the relative number of branched or aggregate shapes in carbon black materials with high OAN values indicating a high structure carbon black material. A high structure carbon black material can cause an increase in modulus and viscosity values in conductive compositions incorporating such carbon black materials.

As used herein, a high structure carbon black material can have a BET value of about 400 or more in certain embodiments, a BET value of about 1,000 or more in certain embodiments, or a BET value of about 500 to about 1,700. A high structure carbon black material can also, or alternatively, exhibit an OAN value of about 250 or more in certain embodiments, an OAN value of about 450 or more in certain embodiments, or an OAN value between about 275 and about 600 in certain embodiments. Examples of commercial high structure carbon black materials can include Ensaco 350G (Imerys Graphite and Carbon), Vulcan VXCMax CSX922 (Cabot Corp.), and Ketjenblack EC600JD (AkzoNobel).

As used herein, a low structure carbon black material can have a BET value of about 400 or less in certain embodiments, a BET value of about 200 or less in certain embodiments, or a BET value of about 40 to about 200. A low structure carbon black material can also, or alternatively, exhibit an OAN value of about 250 or less in certain embodiments, an OAN value of about 150 or less in certain embodiments, or an OAN value between about 100 and about 225 in certain embodiments. Commercial examples of low structure carbon black materials include Conductex 7055 Ultra (Birla Carbon), Conductex 7060 (Birla Carbon), and Vulcan XC 68 (Cabot Corp.).

In certain embodiments, a conductive composition can include a high structure carbon black material and a low structure carbon black material. In certain embodiments, 50% or more of the total carbon black material present in the conductive composition can be a low structure carbon black material; and in certain embodiments 80% or more of the total carbon black material present in the conductive composition can be a low structure carbon black material. In certain embodiments, the ratio of low structure carbon black material to high structure carbon black material can be about 2 to about 1 in certain embodiments, about 3 to about 1 in certain embodiments, about 4 to about 1 in certain embodiments, about 5 to about 1 in certain embodiments, or about 6 to about 1 in certain embodiments. The inclusion of both a high structure carbon black material and low structure carbon black material can have several benefits including optimization of thermal conductivity values, zero shear capillary viscosity values, and elongation at break percentages. In certain embodiments including both a high structure carbon black material and a low structure carbon black material, the conductive composition does not require additional fillers, but can optionally include additional fillers.

In certain embodiments, a low structure carbon black material can be about 10% to about 30%, by weight, of the conductive composition; and in certain embodiments, from about 15% to about 25%, by weight, of the conductive composition. In certain embodiments, a high structure carbon black material can be from 0.5% to about 10%, by weight, of the conductive composition. The total weight of a low structure carbon black material and a high structure carbon black material can comprise 15% or more, by weight, of a conductive composition.

In certain embodiments, additional fillers can optionally be included in a conductive composition. Suitable additional fillers can include thermally conductive fillers such as graphene, quartz, mica, nano clay, calcined clay, talc, calcium carbonite, alumina, metal oxides, metal hydroxides, metal nitrides, metal carbides, metal powders, and combinations thereof. The conductive composition as described herein can be substantially free of any graphite. The inclusion of a highly thermally conductive filler can help increase the thermal conductivity of a conductive composition or to modify other properties such as elongation at break percentages. In certain embodiments, loading quantities of the additional filler can range from about 0.5% to about 10%, by weight of the conductive composition. In certain embodiments, the additional filler can be included in the conductive composition from about 1% to about 8%, by weight of the conductive composition. As can be appreciated, more than one additional filler can be included in a conductive composition.

Numerous metal components can be included as additional fillers. For example, suitable examples of metal oxides that can be used as additional fillers can include zinc oxide, magnesium oxide, aluminum oxide, silicon dioxide, and combinations thereof. As will be appreciated, aluminum oxide and silicon dioxide can optionally be supplied as spherical alumina and spherical silica respectively. Metal nitrides suitable for inclusion in the conductive composition as an additional filler can include boron nitride, aluminum nitride and combinations thereof. Suitable metal silicate salts can include lithium silicate, sodium silicate, sodium metasilicate, potassium silicate, rubidium silicate, cesium silicate and combinations thereof Non-limiting examples of suitable metal hydroxides can include aluminum hydroxide ("alumina"), calcium hydroxide, copper hydroxide, iron oxide, silanols and combinations thereof. Metal carbides suitable for use as an additional filler in the conductive composition can include one or more of boron carbide, silicon carbide, chromium carbide, zirconium carbide, tantalum carbide, vanadium carbide, and tungsten carbide and combinations thereof. Finally, metal powders including, for example, metal powders made from steel, aluminum, cobalt, copper, nickel, chromium, zinc, alloys thereof, and super alloys (e.g., inconel), and combinations thereof can be used as additional fillers.

In certain embodiments, a conductive composition can include additional ingredients. For example, a conductive composition can additionally include one or more of an antioxidant or processing oil.

According to certain embodiments, suitable antioxidants for inclusion in the conductive composition can include, for example, amine-antioxidants, such as 4,4'-dioctyl diphenylamine, N,N'-diphenyl-p-phenylenediamine, and polymers of 2,2,4-trimethyl-1,2-dihydroquinoline; phenolic antioxidants, such as thiodiethylene bis [3-(3,5-di-tert-butyl-4-hydroxyphenyl)propionate], 4,4'-thiobis(2-tert-butyl-5-methylphenol), 2,2'-thiobis(4-methyl-6-tert-butyl-phenol), benzenepropanoic acid, 3,5-bis(1,1-dimethylethyl)4-hydroxy benzenepropanoic acid, 3,5-bis(1,1-dimethylethyl)-4-hydroxy-C13-15 branched and linear alkyl esters, 3,5-di-tert-butyl-4hydroxyhydrocinnamic acid C7-9-branched alkyl ester, 2,4-dimethyl-6-t-butylphenol tetrakis{methylene-3-(3',5'-ditert-butyl-4'-hydroxyphenol) propionate}methane or tetrakis {methylene3-(3',5'-ditert-butyl-4'-hydrocinnamate}methane, 1,1,3tris(2-methyl-4-hydroxyl-5-butylphenyl)butane, 2,5,di t-amyl hydroqunone, 1,3,5-tri methyl2,4,6tris(3,5di tert butyl-4-hydroxybenzyl) benzene, 1,3,5tris(3,5di-tert-butyl-4-hydroxybenzyl)isocyanurate, 2,2-methylene-bis-(4-methyl-6-tert butyl-phenol), 6,6'-di-tert-butyl-2,2'-thiodi-p-cresol or 2,2'-thiobis(4-methyl-6-tert-butylphenol), 2,2-ethylenebis(4,6-di-t-butylphenol), triethyleneglycol bis {3-(3-t-butyl-4-hydroxy-5methylphenyl)propionate}, 1,3,5-tris(4tert-butyl-3-hydroxy-2,6-dimethylbenzyl)-1,3,5-triazine-2,4,6-(1H,3H, 5H)trione, 2,2-methylenebis {6-(1-methyl cyclohexyl)-p-cresol}; sterically hindered phenolic antioxidants such as pentaerythritol tetrakis(3-(3,5-di-tert-butyl-4-hydroxyphenyl)propionate); hydrolytically stable phosphite antioxidants such as tris(2,4-ditert-butylphenyl)phosphite; and/or sulfur antioxidants, such as bis(2-methyl-4-(3-n-alkylthiopropionyloxy)-5-t-butylphenyl)sulfide, 2-mercaptobenzimidazole and its zinc salts, pentaerythritol-tetrakis(3-laurylthiopropionate), and combinations thereof. Antioxidants can be included in the conductive composition in amounts at about 0.5%, by weight, or less in certain embodiments; at about 0.4%, by weight, or less in certain embodiments; and at about 0.2%, by weight, or less in certain embodiments. In certain embodiments, it can be advantageous to use a blend of multiple antioxidants such as a blend of a sterically hindered phenolic antioxidant and a hydrolytically stable phosphite antioxidant.

A processing oil can be used to improve the processability of a conductive composition by forming a microscopic dispersed phase within a polymer carrier. During processing, the applied shear can separate the process aid (e.g., processing oil) phase from the carrier polymer phase. The processing oil can then migrate to the die wall to gradually form a continuous coating layer to reduce the backpressure of the extruder and reduce friction during extrusion. The processing oil can generally be a lubricant, such as, stearic acid, silicones, anti-static amines, organic amities, ethanolamides, mono- and di-glyceride fatty amines, ethoxylated fatty amines, fatty acids, zinc stearate, stearic acids, palmitic acids, calcium stearate, zinc sulfate, oligomeric olefin oil, or combinations thereof. In certain embodiments, the processing oil can be included at about 1% or less, by weight of the conductive composition. In certain embodiments, the conductive composition can also be substantially free of any processing oil. As used herein, "substantially free" means that the component is not intentionally added to the composition and, or alternatively, that the component is not detectable with current analytical methods.

A processing oil can alternatively be a blend of fatty acids, such as the commercially available products: Struktol® produced by Struktol Co. (Stow, Ohio), Akulon® Ultraflow produced by DSM N.V. (Birmingham, Mich.), MoldWiz® produced by Axel Plastics Research Laboratories (Woodside, N.Y.), and Aflux® produced by RheinChemie (Chardon, Ohio).

In certain embodiments, a conductive composition can be a thermoplastic composition. However, in certain embodiments, a conductive composition can alternatively be partially or fully cross-linked through a suitable cross-linking agent or method to form a thermoset composition. A non-limiting example of a suitable class of cross-linking agents includes peroxide cross-linking agents such as, for example, α,α'-bis(tert-butylperoxy) disopropylbenzene, di(tert-butylperoxyisopropyl)benzene, dicumyl peroxide, and tert-butylcumyl peroxide. Blends of multiple peroxide cross-linking agents can also be used, such as for example, a blend of 1,1-dimethyl ethyl 1-methyl-1-phenylethyl peroxide, bis(1-methyl-1-phenyl ethyl) peroxide, and [1,3 (or 1,4)-phenylenebis(1-methylethylidene)] bis(1,1-dimethylethyl) peroxide. However, it will be appreciated that other suitable cross-linking agent or method can also be utilized to cross-link the conductive composition, such as for example, radiation cross-linking, heat cross-linking, electron-beam irradiation, addition cross-linking, platinum cured cross-linking, and silane cross-linking agents.

Conductive compositions can be prepared by blending the components/ingredients in conventional masticating equipment, for example, a rubber mill, brabender mixer, banbury mixer, buss-ko kneader, farrel continuous mixer, or twin screw continuous mixer. The components can be premixed before addition to the polyolefin base polymer (e.g., polyolefin). The mixing time can be selected to ensure a homogenous mixture.

Conductive compositions can exhibit a variety of physical, mechanical, and electrical properties. For example, a conductive composition can have an elongation at break when measured in accordance with ASTM D412 (2010) using molded plaques of about 300% or more. In certain embodiments, the elongation at break of the conductive composition can be about 350% or more when measure in accordance with ASTM D412 (2010); in certain embodiments the elongation at break can be about 400% or more; and in certain embodiments the elongation at break can be about 450% or more. Mechanically, the jacket layer can also have a tensile strength of about 2,250 pounds per square inch ("psi") or more according to certain embodiments; and in certain embodiments about 2,500 psi or more.

A conductive composition can also be electrically conductive, or semi-conductive, as demonstrated by a volume resistivity, measured at about 90° C., of about 100 ohm-m or less in certain embodiments, about 75 ohm-m or less in certain embodiments, about 50 ohm-m or less in certain embodiments, about 30 ohm-m or less in certain embodiments, about 25 ohm-m or less in certain embodiments, about 10 ohm-m or less in certain embodiments, and about 4 ohm-m or less in certain embodiments. As used herein, the term electrically conductive includes semi-conductive. As can be appreciated, it can be advantageous in certain applications to employ a jacket layer being conductive or semi-conductive.

The conductive composition, having good physical, mechanical, and electrical properties can be useful in a variety of power cable applications as a jacket layer due to the reduction of the power cable operating temperature caused by the high thermal conductivity. Non-limiting examples of specific power cables that can benefit from the conductive composition can include power transmission cables, distribution cables, underground cables, elevated cables, over ground cables, subsea cables, nuclear cables, mining cables, industrial power cables, transit cables, and as renewal energy cables for applications like solar and wind energy generation. As can be appreciated, power line accessories can also be coated with a conductive composition.

The conductive composition can be applied to a power cable using an extrusion method. In a typical extrusion method, an optionally heated conductor containing one or more insulation layers can be pulled through a heated extrusion die, such as a cross-head die, to apply a layer of melted conductive composition onto the insulation layers. Upon exiting the die, if the conductive composition is adapted as a thermoset composition, the conducting core with the applied conductive composition layer may be passed through a heated vulcanizing section, or continuous vulcanizing section and then a cooling section, such as an elongated cooling bath, to cool. Multiple layers of the conductive composition can be applied through consecutive extrusion steps in which an additional layer is added in each step. Alternatively, with the proper type of die, multiple layers of the conductive composition can be applied simultaneously.

As can be appreciated, power cables can be formed in a variety of configurations including as single-core cables, multi-core cables, tray cables, inter-locked armored cables, and continuously corrugated welded ("CCW") cable constructions. The conductors in such power cables can be surrounded by one or more insulation layers and/or jacket layers. According to certain embodiments, at least one jacket layer is formed with the conductive composition.

An illustrative, single-core, power cable is depicted in FIG. 1. The single-core power cable in FIG. 1 has a conductor 1, a conductor shield 2, an insulation layer 3, an insulation shield 4, a neutral wire 5, and a jacket layer 6. Jacket layer 6 can be formed from the conductive composition. As will be appreciated, certain power cables can also be formed having fewer components and can, for example, optionally omit one or more of the conductor shield 2, insulation shield 4, or neutral wire 5.

One method to reduce the conductor temperature of a power cable is by transmitting heat to the surrounding coating layer(s), which subsequently dissipates the heat to the surrounding environment through at least one of radiation, conduction or convection. The amount of heat transmitted through the surrounding layers is dependent on the thermal conductivity and emissivity of each various coating layers. A higher thermal conductivity and emissivity of a jacket layer helps to lower conductor temperature compared to a bare conductor. As can be appreciated, other layers of a power cable can additionally be formed of a highly thermally conductive composition. For example, in certain embodiments, an insulation layer 3 can be formed of a composition having a thermal conductivity of about 0.27 W/mK or greater at about 75° C. Examples of suitable compositions that exhibit high thermal conductivity are disclosed in U.S. patent application Ser. No. 14/752,454 which is hereby incorporated by reference.

The conductor, or conductive element, of a power cable, can generally include any suitable electrically conducting material. For example, a generally electrically conductive metal such as, for example, copper, aluminum, a copper alloy, an aluminum alloy (e.g. aluminum-zirconium alloy), or any other conductive metal can serve as the conductive material. As will be appreciated, the conductor can be solid, or can be twisted and braided from a plurality of smaller conductors. The conductor can be sized for specific purposes. For example, a conductor can range from a 1 kcmil conductor to a 1,500 kcmil conductor in certain embodiments, a 4 kcmil conductor to a 1,000 kcmil conductor in certain embodiments, a 50 kcmil conductor to a 500 kcmil conductor in certain embodiments, or a 100 kcmil conductor to a 500 kcmil conductor in certain embodiments. The voltage class of a power cable including such conductors can also be selected. For example, a power cable including a 1 kcmil conductor to a 1,500 kcmil conductor and an insulating layer formed from a suitable thermoset composition can have a voltage class ranging from about 1 kV to about 150 kV in certain embodiments, or a voltage class ranging from about 2 kV to about 65 kV in certain embodiments. In certain embodiments, a power cable can also meet the medium voltage electrical properties of ICEA test standard S-94-649-2004.

As a non-limiting example, a conductive composition according to one embodiment can have a thermal conductivity, measured in accordance with the ASTM E1952 (2011) mDSC method at 75° C., that can be about 0.30 W/mK or more. The conductive composition can additionally meet other physical, or mechanical, requirements such as having an elongation at break of about 300% or more, or have a volume resistivity of about 75 ohm-meters or less at 90° C. In certain embodiments, a conductive composition at 75° C. can have a thermal conductivity of about 0.30 W/mK or more; and in certain embodiments, a thermal conductivity of about 0.31 W/mK or more; in certain embodiments, a thermal conductivity of about 0.32 W/mK or more; in certain embodiments, a thermal conductivity of about 0.33 W/mK or more; and in certain embodiments, a thermal conductivity of about 0.34 W/mK or more. The composition can also retain an elongation at break percentage after aging at 100° C. for 168 hours of about 70% or more of the elongation at break percentage of an unaged sample. In certain embodiments, the composition can retain about 90% or more of the elongation at break percentage after aging at 100° C. for about 168 hours when compared to the elongation at break percentage of an unaged sample.

Examples

Table 1 lists suitable materials for each of the components used in the inventive and comparative examples listed in Tables 2 produced below.

TABLE 1

| Material | Trade Name | Supplier |
|---|---|---|
| LLDPE | LL1002.09 | ExxonMobil ™ |
| Propylene-Based Elastomer | Vistamaxx ™ 6102 | ExxonMobil ™ |
| Low Structure Carbon Black (Conventional Furnace Carbon Black) | CD7060 | Columbian Chemicals Company |
| High Structure Carbon Black (Conductive Carbon Black) | Ensaco 350G | Imerys Graphite & Carbon |
| Paraffin Wax | CS-2037P | PMC Crystal |
| Antioxidant 1 | Irganox ® 1035 | BASF Corp. |
| Antioxidant 2 | Irganox ® PS802 | BASF Corp. |
| Antioxidant 3 | Tinuvin ® 622 | BASF Corp. |

Example conductive compositions were produced using various components from Table 1 by mixing each listed component together in each example, with the exception of the polyolefin base polymer to form a mixture. This mixture was then added to the polyolefin base polymer and blended using conventional masticating equipment. Mixing was then performed until a homogenous blend was obtained. Cables were produced by extruding the homogenous conductive composition onto a copper conductor insulated wire to form a 14 AWG cable using conventional extrusion techniques. Measurements, including thermal conductivity, elongation at break, retained elongation at break after heat aging at 100° C. for 168 hours as compared to the unaged elongation at break, volume resistivity measurements at 90° C., and zero shear capillary viscosity at 190° C., were measured for each composition using either test plaques or cables prepared with such conductive compositions. Thermal conductivity was measured in accordance with ASTM E1952 (2011), mDSC method, using enthalpy values obtained from two samples, each of different thickness. Thermal conductivity values were similarly calculated from such enthalpy values.

TABLE 2

| | Comparative Examples | | | | Inventive Examples | | |
|---|---|---|---|---|---|---|---|
| | 1 | 2 | 3 | 4 | 5 | 6 | 7 |
| LLDPE | 80.7 | 71.2 | 80.7 | 57.76 | 57.76 | 80.7 | 74.7 |
| Propylene Elastomer | — | — | — | 14.44 | 14.44 | — | — |
| Low Structure Carbon Black | 17 | 26 | — | — | 19 | 14 | 19 |
| High Structure Carbon Black | — | — | 17 | 25 | 6 | 3 | 4 |
| Paraffin Wax | 1.5 | 2 | 1.5 | 2 | 2 | 1.5 | 1.5 |
| Antioxidant 1 | 0.2 | 0.2 | 0.2 | 0.2 | 0.2 | 0.2 | 0.2 |
| Antioxidant 2 | 0.5 | 0.5 | 0.5 | 0.5 | 0.5 | 0.5 | 0.5 |
| Antioxidant 3 | 0.1 | 0.1 | 0.1 | 0.1 | 0.1 | 0.1 | 0.1 |
| Total | 100 | 100 | 100 | 100 | 100 | 100 | 100 |
| Properties | | | | | | | |
| Thermal Conductivity at 75° C. (W/mK) | 0.25 | 0.34 | 0.25 | 0.26 | 0.30 | 0.27 | — |

TABLE 2-continued

| | Comparative Examples | | | | Inventive Examples | | |
|---|---|---|---|---|---|---|---|
| | 1 | 2 | 3 | 4 | 5 | 6 | 7 |
| Tensile (psi) | 2054 | 3305 | 2172 | 1682 | 1659 | 1825 | 1973 |
| Elongation at Break (%) | 641 | 281 | 313 | 483 | 561 | 796 | 408 |
| Retained Elongation at Break after Aging at 100° C. for 168 Hours as Compared to the Unaged Elongation at Break (%) | 76 | 99 | 13 | 34 | 91 | 45 | — |
| Volume Resistivity at 90° C. (Ohm-m) | 99.52 | 4.69 | 0.04 | 0.01 | 0.07 | 1.72 | 0.15 |
| Zero shear capillary viscosity at 190° C. (Pa.s) | 10813.4 | — | 20688 | 45499.6 | 18864.7 | — | 13614.9 |

Table 2 illustrates conductive compositions for Comparative Examples 1 to 4 and Inventive Examples 5 to 7. Comparative Examples 1 to 4 do not include a blend of high structure carbon black material and low structure carbon black material and fail to exhibit various desirable properties. For example, Comparative Examples 1, 2, and 4 do not exhibit a thermal conductivity of about 0.27 W/mK or more. In turn, Comparative Example 3 exhibits a high thermal conductivity, but has an unacceptably low elongation at break value. Inventive Examples 5 to 7 exhibit a balanced blend of desirable properties including high thermal conductivity and elongation at break values and low volume resistivity values.

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A cable comprising:

one or more conductors; and a covering surrounding the one or more conductors, the covering formed from a conductive composition comprising:

from about 40% to about 90%, by weight of the conductive composition, of a polyolefin base polymer;

from about 10% to about 30%, by weight of the conductive composition, of a first carbon black material comprising a Brunauer, Emmett, and Teller ("BET") value of about 400 or less and an Oil Adsorption Number ("OAN") value in accordance to ASTM D2414 (2014) of about 250 or less; and from about 0.5% to about 10%, by weight of the conductive composition, of a second carbon black material comprising a BET value of about 400 or more, and an OAN value of about 250 or more; and wherein the covering exhibits two or more of:

a thermal conductivity of about 0.27 W/mK or more when measured at about 75° C.;

a volume resistivity of about 75 ohm-m or less, when measured at about 90° C.; and an elongation at break of about 300% or more.

2. The cable of claim 1, wherein the first carbon black material comprises a BET value between about 40 and about 200 and an OAN value between about 100 to about 225.

3. The cable of claim 1, wherein the second carbon black material comprises a BET value between about 500 to about 1700 and an OAN value between about 275 to about 600.

4. The cable of claim 1, wherein the first carbon black material and the second carbon black material collectively comprise about 15% or more, by weight, of the conductive composition.

5. The cable of claim 1, wherein the first carbon black material comprises about 50% or more of the total carbon black present in the conductive composition.

6. The cable of claim 1, wherein the first carbon black material and the second carbon black material are each selected from the group consisting of furnace carbon black, channel carbon black, acetylene carbon black, graphitic carbon black, thermal carbon black, lamp carbon black, highly conductive carbon black, and combinations thereof.

7. The cable of claim 1, wherein the conductive composition further comprises a filler comprising one or more of graphene, quartz, mica, nano clay, calcined clay, talc, calcium carbonite, alumina, metal oxide, metal hydroxide, metal carbide, metal nitride, and metal powder.

8. The cable of claim 7, wherein the filler comprises about 10% or less, by weight of the conductive composition.

9. The cable of claim 1, wherein the conductive composition further comprises about 1% to about 20%, by weight of the conductive composition, of an elastomer having a melting point between about 25° C. and about 100° C.; and wherein the elastomer comprises one or more of polypropylene copolymer and polyethylene copolymer.

10. The cable of claim 1, wherein the conductive composition further comprises an antioxidant or processing oil.

11. The cable of claim 1, wherein the polyolefin base polymer comprises one or more of low-density polyethylene, high-density polyethylene, high molecular weight polyethylene, ultra-high molecular weight polyethylene, linear low-density polyethylene, and very low-density polyethylene.

12. The cable of claim 1, wherein the polyolefin base polymer comprises linear low-density polyethylene.

13. The cable of claim 1, wherein the covering exhibits a zero shear capillary viscosity of about 25,000 Pa·s or less when measured at about 190° C.

14. The cable of claim 1, wherein the covering exhibits:

a thermal conductivity of about 0.27 W/mK or more when measured at about 75° C.;

a volume resistivity of about 75 ohm-m or less, when measured at about 90° C.; and an elongation at break of about 300% or more.

15. The cable of claim 1, wherein the covering exhibits a thermal conductivity of about 0.30 W/mK or more when measured at about 75° C.

16. The cable of claim 1, wherein the covering retains an elongation at break percentage after aging at 100° C. for 168 hours of about 70% or more of the unaged elongation at break percentage.

17. The cable of claim 1 wherein the covering is thermoplastic.

18. The cable of claim 1 further comprises an insulation layer surrounding the one or more conductors, and wherein the covering is a jacket layer and surrounds the insulation layer.

19. A conductive composition comprising:

from about 40% to about 90%, by weight, of a polyolefin base polymer;

from about 10% to about 30%, by weight, of a first carbon black material comprising a Brunauer, Emmett, and Teller ("BET") value of about 400 or less and an Oil Adsorption Number ("OAN") value in accordance to ASTM D2414 (2014) of about 250 or less; and from about 0.5% to about 10%, by weight, of a second carbon black material comprising a BET value of about 400 or more and an OAN value of about 250 or more; and wherein the conductive composition exhibits two or more of:

a thermal conductivity of about 0.27 W/mK or more when measured at about 75° C.;

a volume resistivity of about 75 ohm-m or less, when measured at about 90° C.; and an elongation at break of about 300% or more.

20. A cable comprising:

one or more conductors;

a covering surrounding the one or more conductors, the covering formed of a covering composition comprising:

from about 40% to about 90%, by weight of the jacket composition, of a polyolefin base polymer;

from about 10% to about 30%, by weight of the jacket composition, of a first carbon black material comprising a Brunauer, Emmett, and Teller ("BET") value of about 400 or less and an Oil Adsorption Number ("OAN") value in accordance to ASTM D2414 (2014) of about 250 or less; and from about 0.5% to about 10%, by weight of the jacket composition, of a second carbon black material comprising a BET value of about 400 or more and an OAN value of about 250 or more; and wherein the covering exhibits two or more of:

a volume resistivity of about 75 ohm-m or less, when measured at about 90° C.;

an elongation at break of about 300% or more; and an elongation at break percentage after aging at 100° C. for 168 hours of about 70% or more of the unaged elongation at break percentage.

* * * * *